US012752960B2

(12) United States Patent
Hengami

(10) Patent No.: US 12,752,960 B2
(45) Date of Patent: Oct. 6, 2026

(54) TWO OR MORE COMPARTMENT DISPENSING BOX WITH TOP SIDE SLIDE OPENINGS

(71) Applicant: David Hengami, Torrance, CA (US)

(72) Inventor: David Hengami, Torrance, CA (US)

(73) Assignee: Revobox Dispensing Technologies, LLC, Torrance, CA (US)

( * ) Notice: Subject to any disclaimer, the term of this patent is extended or adjusted under 35 U.S.C. 154(b) by 294 days.

(21) Appl. No.: 18/495,039

(22) Filed: Oct. 26, 2023

(65) Prior Publication Data

US 2024/0051708 A1 Feb. 15, 2024

Related U.S. Application Data

(63) Continuation-in-part of application No. 17/711,512, filed on Apr. 1, 2022, now abandoned, which is a (Continued)

(51) Int. Cl.
*B65D 5/72* (2006.01)
*B65D 5/02* (2006.01)

(Continued)

(52) U.S. Cl.
CPC ..... *B65D 5/723* (2013.01); *B65D 5/0227* (2013.01); *B65D 5/4266* (2013.01); *B65D 5/48014* (2013.01); *B65D 85/60* (2013.01)

(58) Field of Classification Search
CPC ..... B65D 5/4814; B65D 5/423; B65D 5/646; B65D 85/60

(Continued)

(56) References Cited

U.S. PATENT DOCUMENTS 1,543,953 A 6/1925 Rothschild
1,951,274 A 3/1934 Denman (Continued)

FOREIGN PATENT DOCUMENTS

CN 204399639 6/2015
DE 10044018 3/2002

(Continued)

OTHER PUBLICATIONS

PCT/US2011/021014. International Search Report and Written Opinion dated Jan. 12, 2011. 9 pages.

(Continued)

*Primary Examiner* — Nathan J Newhouse
(74) *Attorney, Agent, or Firm* — Concourse Law Group; Katherine B. Sales, Esq.

(57) ABSTRACT

A blank for forming a box, the blank comprising a plurality of side panels, at least two compartment slides, at least one separator panel, and at least one support tab. The plurality of side panels are configured to form a box having two or more compartments, the compartments having a common front panel with two or more apertures, one for each compartment. The compartment slides are independently moveable to selectively block and unblock their respective aperture. The support tab is configured to press the compartment slides against the front panel proximate the apertures upon formation of the box. A box having two or more compartments for dispending two or more products.

13 Claims, 6 Drawing Sheets

Related U.S. Application Data continuation of application No. 17/140,513, filed on Jan. 4, 2021, now Pat. No. 11,292,634, which is a continuation of application No. 16/387,495, filed on Apr. 17, 2019, now Pat. No. 10,899,496.

(60) Provisional application No. 62/659,064, filed on Apr. 17, 2018.

(51) Int. Cl.
*B65D 5/42* (2006.01)
*B65D 5/48* (2006.01)
*B65D 85/60* (2006.01)

(58) Field of Classification Search
USPC ..... 229/120.02, 120.03, 120.08, 125.12, 229/125.15, 120.12, 129.1, 120.24, 220, 229/120.11, 121; 221/91; 222/529
See application file for complete search history.

(56) References Cited

U.S. PATENT DOCUMENTS 2,000,210 A 5/1935 Bayless
2,330,926 A 10/1943 Rous
2,342,081 A 2/1944 Kirkland et al.
2,349,748 A 5/1944 Otto
2,507,430 A 5/1950 Yancey
2,857,881 A 10/1958 Beebe
2,903,175 A 9/1959 Peimer
2,950,851 A 8/1960 Peimer
2,983,421 A 5/1961 Turpin
2,983,424 A 5/1961 Glass
3,009,565 A 11/1961 Leone
3,016,178 A 1/1962 Knocks
3,033,436 A 5/1962 Peimer
3,040,953 A 6/1962 Tindall
3,079,062 A 2/1963 Craddock
3,082,929 A 3/1963 Aquino et al.
3,115,290 A 12/1963 Byassee
3,126,141 A 3/1964 Walter
3,229,888 A 1/1966 Gillam
3,438,482 A 4/1969 Hamilton
3,441,125 A 4/1969 Small
3,539,089 A 11/1970 Osberg
3,610,510 A 10/1971 Lowry
3,669,336 A 6/1972 Robinson
3,819,093 A 6/1974 Forbes
3,907,108 A 9/1975 Weimer
4,054,203 A 10/1977 Farquhar
4,063,679 A 12/1977 Henry
4,081,128 A 3/1978 O'Neill
4,094,456 A 6/1978 Roccaforte
4,141,485 A 2/1979 Lambert
4,197,985 A 4/1980 Austin
4,201,329 A 5/1980 Roccaforte
4,274,578 A 6/1981 Montealegre
4,349,105 A 9/1982 Bradley et al.
4,361,270 A * 11/1982 Roccaforte ..... B65D 5/723 229/120.03
4,438,848 A 3/1984 Montealegre
4,452,355 A 6/1984 Benham
4,548,318 A 10/1985 Boyle
4,609,142 A 9/1986 Adamek
5,040,721 A 8/1991 Essack
D319,976 S 9/1991 Wortley et al.
D320,935 S 10/1991 Nylander
5,056,708 A 10/1991 Boyle
5,135,158 A 8/1992 Boyle et al.
5,145,070 A 9/1992 Pallett et al.
5,197,625 A 3/1993 Mullaney
5,348,219 A 9/1994 Brintazzol
D361,262 S 8/1995 Lusker
5,465,834 A 11/1995 Sieber et al.
5,505,370 A 4/1996 Brown et al.
5,505,373 A 4/1996 Von Stillfried
5,540,330 A 7/1996 Lo Duca
5,607,058 A 3/1997 Huesman et al.
D390,330 S 2/1998 Skaya
5,725,620 A 3/1998 Perea et al.
5,845,424 A 12/1998 Mitchell
5,918,799 A 7/1999 Walsh
5,927,498 A 7/1999 Saam
D425,413 S 5/2000 Heeley et al.
6,079,563 A 6/2000 Katchmazenski
6,116,499 A 9/2000 Hengami
6,227,440 B1 5/2001 Hart
6,273,332 B1 8/2001 Hengami
6,360,942 B2 3/2002 Hengami
D455,455 S 4/2002 Katsuyama
6,393,707 B1 5/2002 Maffei
6,394,275 B1 5/2002 Paliotta et al.
6,435,402 B1 * 8/2002 Hengami ..... B65D 5/0263 229/131.1
6,474,040 B1 11/2002 Ours et al.
6,637,646 B1 10/2003 Muise et al.
6,691,869 B2 2/2004 Knaack et al.
6,733,555 B1 5/2004 Wilder
6,889,892 B2 5/2005 Walsh et al.
D508,850 S 8/2005 Ghini et al.
6,945,449 B2 9/2005 Hengami
6,971,524 B1 12/2005 Voswinkel
7,040,528 B2 5/2006 Hengami
7,097,043 B2 8/2006 Hsu
7,156,286 B2 1/2007 Hengami
D551,967 S 10/2007 Hengami
D552,987 S 10/2007 Magnusson
7,337,904 B2 3/2008 Hengami
D580,754 S 11/2008 An
7,494,044 B2 2/2009 Walsh et al.
7,503,475 B2 3/2009 McGowan
D594,743 S 6/2009 Lukka
7,661,578 B2 2/2010 Li
7,743,973 B2 6/2010 Hengami
7,992,764 B2 8/2011 Magnusson
8,261,964 B2 9/2012 Raupach et al.
8,499,999 B2 8/2013 Sieber et al.
8,739,969 B2 6/2014 Schuld
8,800,855 B2 8/2014 Fitzwater
8,844,797 B2 9/2014 Smith
9,085,386 B2 7/2015 Hengami
9,394,066 B2 7/2016 Hengami
9,394,076 B2 7/2016 Hengami
9,561,878 B2 2/2017 Lee et al.
9,643,749 B2 5/2017 Wagner
10,086,990 B2 10/2018 Hengami
10,899,496 B2 * 1/2021 Hengami ..... B65D 5/4266
11,066,209 B2 7/2021 Hengami
11,111,052 B2 9/2021 Hengami
11,180,281 B2 11/2021 Hengami
11,186,405 B2 11/2021 Hengami
11,220,369 B2 1/2022 Hengami
11,292,634 B2 * 4/2022 Hengami ..... B65D 5/48014
11,661,232 B2 5/2023 Hengami
11,667,431 B1 6/2023 Hengami
11,691,779 B2 7/2023 Hengami
11,691,783 B1 7/2023 Hengami
2003/0217944 A1 11/2003 Belloli et al.
2003/0230498 A1 12/2003 Maute
2004/0065723 A1 * 4/2004 Hengami ..... B65D 5/723 229/125.12
2005/0061864 A1 3/2005 Lee
2005/0067476 A1 3/2005 Hengami
2005/0098616 A1 5/2005 Chang
2005/0211754 A1 9/2005 Fulcher
2006/0124709 A1 6/2006 Hengami
2007/0251848 A1 11/2007 Hengami
2007/0261990 A1 11/2007 Weston et al.
2008/0128478 A1 6/2008 Quadrelli
2008/0128480 A1 6/2008 Hengami
2011/0057024 A1 3/2011 Sieber et al.
2011/0062175 A1 3/2011 Nakamura et al.
2011/0111938 A1 5/2011 Smith
2011/0162997 A1 7/2011 Robbins et al.

(56) References Cited

U.S. PATENT DOCUMENTS

| | | | | |
|---|---|---|---|---|
| 2011/0168767 | A1 | 7/2011 | Hengami | |
| 2013/0075462 | A1 | 3/2013 | Jones et al. | |
| 2015/0321788 | A1* | 11/2015 | Hengami | B65D 5/0227 229/122 |
| 2016/0297589 | A1 | 10/2016 | You et al. | |
| 2019/0144156 | A1 | 5/2019 | Hengami | |
| 2021/0122519 | A1 | 4/2021 | Hengami | |

FOREIGN PATENT DOCUMENTS

| | | | | |
|---|---|---|---|---|
| EP | 0732269 | | 9/1996 | |
| EP | 0642977 | | 12/1996 | |
| EP | 0761550 | | 3/1997 | |
| FR | 2799743 | | 4/2001 | |
| FR | 2799743 | A1 * | 4/2001 | B65D 5/723 |
| JP | 07223634 | | 8/1995 | |
| JP | 07223634 | A * | 8/1995 | B65D 5/723 |

OTHER PUBLICATIONS

PCT/US2022/34764. International Search Report and Written Opinion dated Oct. 19, 2022.

https://issuu.com/designpackaging/docs/packaging-dielines-free-book-design Packaging & Dielines: The Designer's Book of Packaging Dieline; published at least as early as Sep. 18, 2019; 2 pages.

http://samanthaleewalker.blogspot.in/2012/12/ornament-box-tutorial.html Samantha Walker's Imaginary World: Ornamental Box Tutorial; retrieved Aug. 2, 2018; 1 page.

https://www.pinterest.se/pin/15692298672213867/?lp=true Corrugated Box with internal insert #packaging; retrieved Aug. 2, 2018; 1 page.

* cited by examiner

TWO OR MORE COMPARTMENT DISPENSING BOX WITH TOP SIDE SLIDE OPENINGS

CROSS-REFERENCE TO RELATED APPLICATIONS

This application is a continuation-in-part application of U.S. patent application Ser. No. 17/711,512, titled "Dual Compartment Dispensing Box with Top Slide Openings," filed Apr. 1, 2022, which is a continuation application of United Stated patent application Ser. No. 17/140,513, titled "Dual Compartment Dispensing Box with Top Slide Openings," filed Jan. 4, 2021, which is a continuation application of U.S. patent application Ser. No. 16/387,495, now U.S. Pat. No. 10,899,496, titled "Dual Compartment Dispensing Box With Top Slide Openings," filed Apr. 17, 2019, which claims priority to provisional application No. 62/659,064 filed Apr. 17, 2018 entitled "Dual Compartment Dispensing Box With Top Slide Openings." The contents of both of these applications are incorporated by reference in their entirety.

BACKGROUND

Major food and candy manufacturers employ high-speed form, fill and seal packaging machines to produce numerous folded, filled and sealed boxes of a solid pourable product per minute. These machines typically receive either flat box blanks or partially-constructed boxes. A first end is folded and sealed. Then the boxes are filled with the product before the opposite end is folded and sealed, thereby finishing the manufacturing process. The types of solid pourable products such packaging machines are frequently used to package are, for example, mints, small candies, or similar items. To facilitate dispensing and present such a box more favored by consumers, the rapid form, fill and seal boxes often incorporate re-closable openings formed as part of the blank itself.

One type of closable box known in the art is formed from a cardboard box blank that may be rapid folded, and which offers a re-closable, sliding opening incorporated into the unassembled blank, and which is constructed during the folding process prior to sealing. Known types of closable boxes with slides include those having slides that move up and down at the top of the box and include a catch mechanism to prevent the slide from dislodging. Up to now, such boxes have been limited in that they include a convenient slide opening, but only have one opening and thus can contain only one product.

Therefore there remains a need for a box having two compartments and offering a convenient dual slide opening for easily dispensing a solid pourable or similar product, that is easy to manufacture on a mass production scale using conventional high-speed packaging machines, and that is constructed in such a way to avoid any slide insertion step, but that incorporates multiple independently operable slide openings. There is further a need for such a box having these characteristics while also having the same appearance and handling characteristics as a conventional box, wherein the top flaps are individually lifted to individually dispense the contents according to preference, and which is made from a single sheet of blank stock.

SUMMARY

A package for convenient dispensing of multiple kinds of candies, mints or the like starts with a single cardboard blank having a plurality of longitudinally extending side panels, a first compartment slide, a second compartment slide, a separator panel, and a support tab.

The plurality of longitudinally extending side panels can be formed into a box having a first compartment and a second compartment. The first compartment and the second compartment have a common front panel with a pair of apertures for the first compartment and the second compartment respectively.

The pair of apertures are sized to dispense the multiple types of solid pourable product therethrough.

The first compartment slide and the second compartment slide are independently moveable to selectively block and unblock each of the pair of apertures.

The separator panel is disposed between the first compartment and the second compartment and is at least partially defined by an inner tab to one edge of the panel. The inner tab is adhesively connected to the interior of the front panel.

The support tab is disposed to press the first compartment slide and the second compartment slide against the front panel proximate the pair of apertures upon formation of the box.

Optionally, the first and second compartment slides each have a catch to keep at least a portion of the first compartment slide and at least a portion of the second compartment slide captive inside the box upon formation of the box.

Optionally, the package further has a first compartment rear panel and a rear panel, a lateral edge of the first compartment rear panel being adhesively connected to the rear panel.

Optionally, the plurality of compartments fully extend to a bottom of the multi compartment package.

Optionally, the first compartment slide and second compartment slide are vertically movable within an interior of the multi compartment package.

Optionally, the blank has a plurality of flap portions foldably extending from the plurality of longitudinally extending side panels, the flap portions being top and bottom flaps.

BRIEF DESCRIPTION OF THE DRAWINGS

These and other features, aspects and advantages of the present invention will become better understood with reference to the following description, appended claims, and accompanying drawings where:

DESCRIPTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

For purposes of the following discussion, box portions bearing the slides will be discussed as though oriented as the front of the box.

Figure 1:
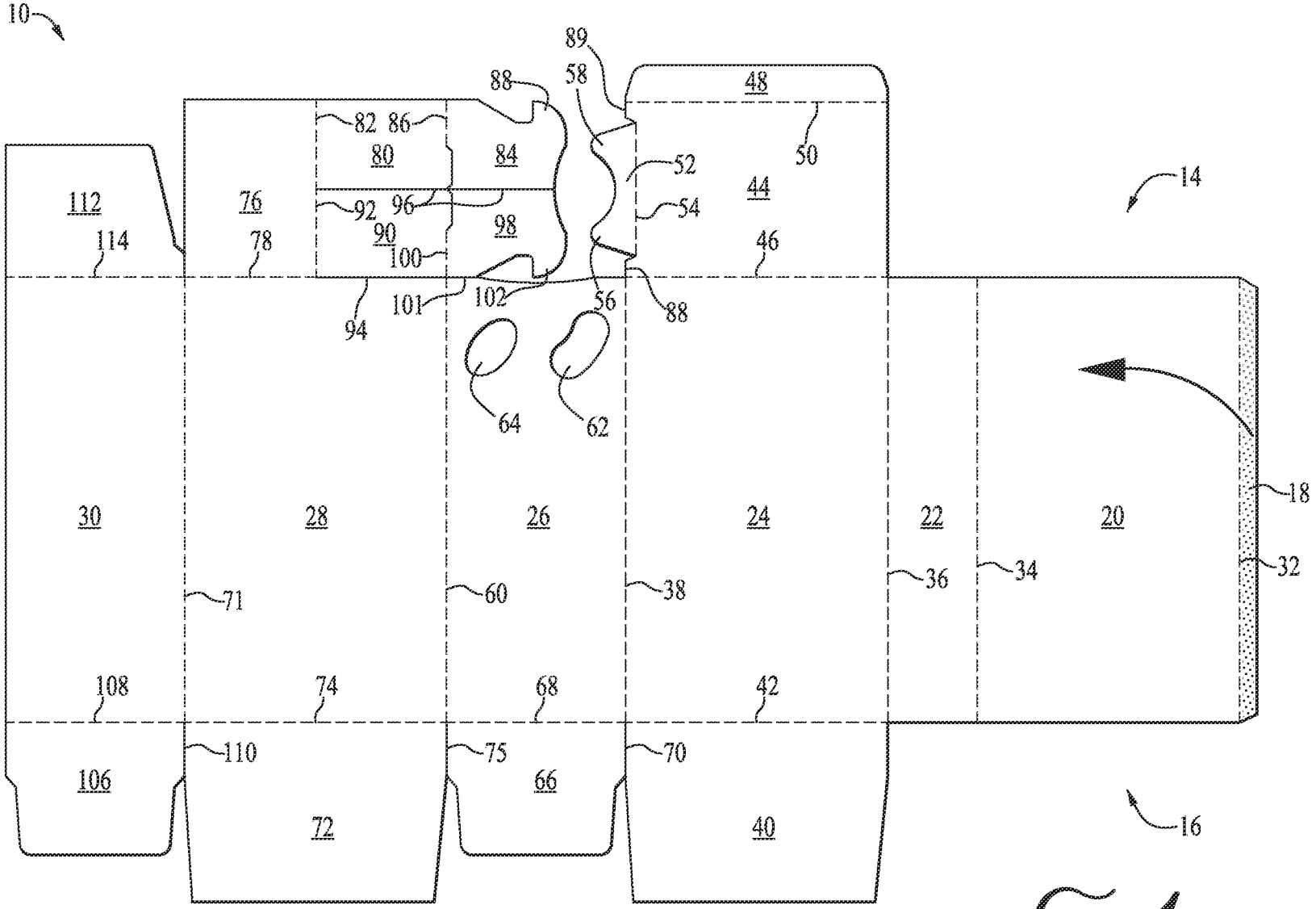
FIG. 1 is a flat pattern view of a first embodiment of a cardboard blank which can be folded to form a dual compartment box with slide openings.

Referring to FIG. 1, there is shown a first embodiment of a die cut paper or cardboard blank 10 that may be used to form the box 12 (FIGS. 3-6). The cardboard blank 10 has a top end 14 and a bottom end 16 and is scored for folding such that the box 12 has at least two compartments, comprising at least a first compartment 116 and a second compartment 118 (FIG. 3), preferably adjacent to one another. Major portions of the cardboard blank include inner tab 18, dual compartment separator panel 20, first compartment rear panel 22, first compartment side panel 24, front panel 26, second compartment side panel 28, rear panel 30, preferably all arranged in series and preferably configured in a foldable relationship to one another.

Still referring to FIG. 1, inner tab 18 is connected to dual compartment separator panel 20 along inner tab fold line 32. Dual compartment separator panel 20 is connected to first compartment rear panel 22 by dual compartment separator panel fold line 34. First compartment rear panel 22 is connected to first compartment side panel 24 by first compartment rear panel fold line 36. First compartment side panel 24 is connected to front panel 26 by first compartment side panel fold line 38. First compartment side panel 24 includes first bottom flap 40 connected along first bottom flap fold line 42. First compartment side panel 24 also includes major lid 44 connected along major lid fold line 46, major lid closure tab 48 connected along major lid closure tab fold line 50, and front tab 52 connected along front tab fold line 54. Note that tab 48 is optional and can be excluded to reduce the overall size of the blank 10 for paper or cardboard material savings. Major lid 44 includes first catch 88 and second catch 89, and front tab 52 includes first appendage 56 and second appendage 58.

Front panel 26 is connected to second compartment side panel 28 along front panel fold line 60. Front panel 26 lacks a top tab, but includes a second bottom flap 66 connected along second bottom flap fold line 68. Second bottom flap 66 is adjacent first bottom flap 40 and separated by first cut line 70. Front panel 26 includes first compartment aperture 62 and second compartment aperture 64.

Second compartment side panel 28 is connected to rear panel 30 along second compartment side panel fold line 71. Second compartment side panel 28 includes third bottom flap 72 connected along third bottom flap fold line 74. Third bottom tab 72 is adjacent second bottom tab 66, separated along second cut line 75. Second compartment side panel 28 also includes minor lid 76 connected along minor lid fold line 78. Both minor lid 76 and minor lid fold line 78 are preferably approximately one-half the width of second compartment side panel 28. Along the remaining width of the top end 14 of the second compartment side panel 28 is third cut line 94. Second compartment slide flap 90 is adjacent second compartment side panel 28 along third cut line 94. Second compartment slide 98 is connected to second compartment slide flap 90 along second compartment slide fold line 100, and is partially adjacent front panel 26 along fifth cut line 101. Second compartment slide 98 includes third catch 102. First compartment slide flap 80 is attached to minor lid 76 along first compartment slide flap fold line 82, and adjacent to second compartment slide flap 90 along fourth cut line 96. First compartment slide 84 is connected to first compartment slide flap 80 along first compartment slide fold line 86, and adjacent to second compartment slide 98 along fourth cut line 96. First compartment slide 84 includes fourth catch 104.

Rear panel 30 is connected to second compartment side panel 28 along second compartment side panel fold line 71. Rear panel 30 includes fourth bottom flap 106 connected along fourth bottom flap fold line 108 and top flap 112 connected along top flap fold line 114. Fourth bottom flap 106 is adjacent third bottom tab 72 along sixth cut line 110. As shown by the arrow in FIG. 1, a first step in assembling the box 12 from the cardboard blank 10 may be folding inner tab 18, dual compartment separator panel 20, first compartment rear panel 22, and first compartment side panel 24 preferably over one-half the width of front panel 26.

Figure 2:
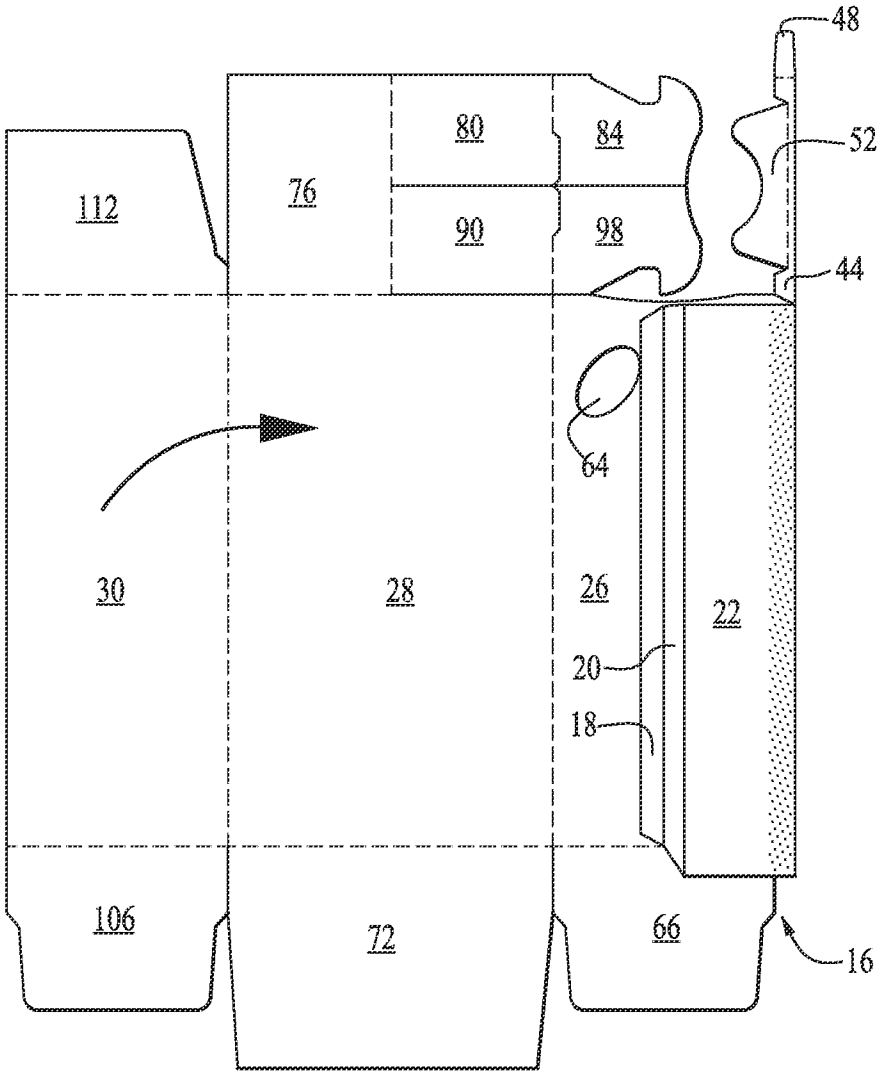
FIG. 2 is a perspective view of the cardboard blank showing a first assembly step toward forming the dual compartment box with slide openings.

Referring to FIG. 2, first compartment rear panel 22 has been folded over front panel 26 with inner tab 18 affixed thereto, thereby forming first compartment 116. Preferably, upon folding, dual compartment separator panel 20 and first compartment side panel 24 are at substantial right angles to first compartment rear panel 22. Additionally, inner tab 18 is preferably reverse folded to extend away from first compartment 116 when adhesively adhered or otherwise affixed to front panel 26. As shown by the arrow in FIG. 2, rear panel 30 is folded over front panel 26 and first compartment 116 formed by dual compartment separator panel 20, first compartment rear panel 22, and first compartment side panel 24. Preferably upon folding, front panel 26 and rear panel 30 are at substantial right angels from second compartment side panel 28. Preferably rear panel 30 is adhesively adhered or otherwise affixed to first compartment rear panel 22 of first compartment 116 thereby forming the box 12.

Figure 3:
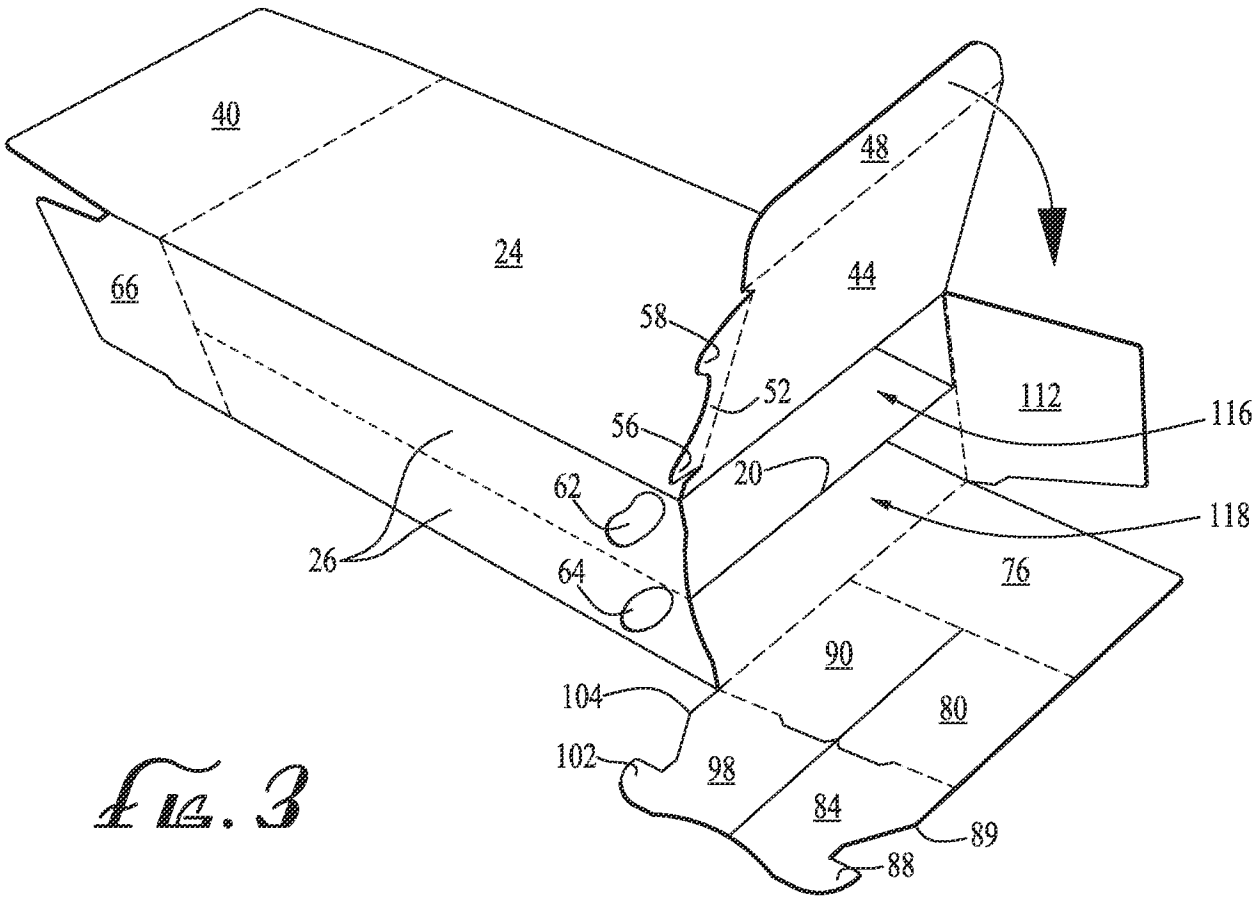
FIG. 3 is a perspective view of the cardboard blank showing a second assembly step toward forming the dual compartment box with slide openings.

Referring now to FIG. 3 with back panel 30 folded over first compartment rear panel 22 of first compartment 116, second compartment 118 is formed. A next assembly step of the box 12 may be folding top flap 112 over first compartment 116 and second compartment 118. As shown by the arrow in FIG. 3, a next assembly step of the box 12 may be folding major lid 44 over top flap 112, first compartment 116, and second compartment 118. Upon folding, major lid 44, major lid closure tab 48 is folded substantially at a right angle from major lid 44 to rest against second compartment side panel 28. Similarly, front tab 52 is folded at a substantial right angle from major lid 44, with first appendage 56 inserted into first compartment 116 and second appendage 58 inserted into second compartment 118. First appendage 56 helps to press first compartment slide 84 against first compartment aperture 62, when folded into first compartment 116, and second appendage 58 helps to press second compartment slide 98 against second compartment aperture 64 when folded into second compartment 118.

Figure 4:
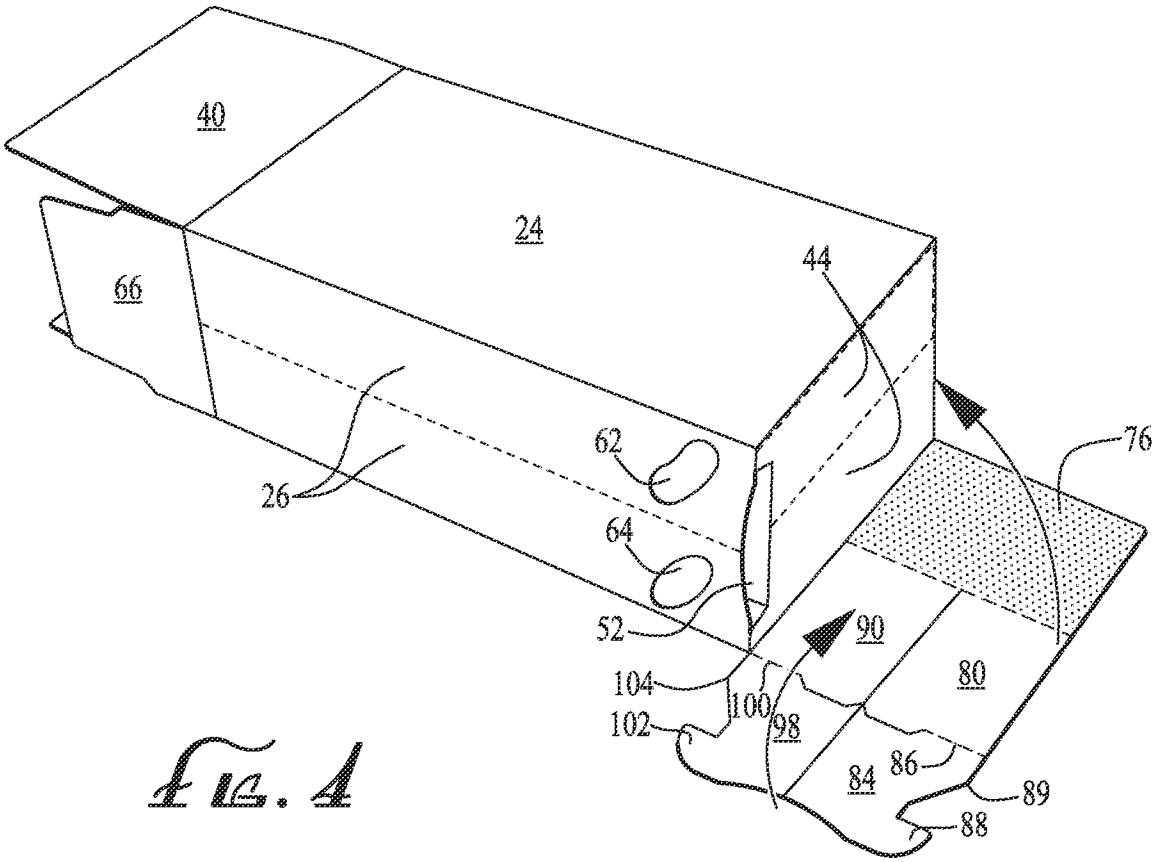
FIG. 4 is a perspective view of the cardboard blank showing a third and fourth assembly step toward forming the dual compartment box with slide openings, with the bottom flaps open.

Referring to FIG. 4, as shown by arrow adjacent first compartment slide 84 and second compartment slide 98, a next assembly step may be folding first compartment slide 84 substantially ninety degrees at first compartment slide fold line 86, and folding second compartment slide 98 substantially ninety degrees at second compartment slide fold line 100. Thereafter, minor lid 76 may be folded over major lid 44, such that first compartment slide 84 covers first compartment aperture 62 and second compartment slide 98 covers second compartment aperture 64. These actions may be performed in series or simultaneously according to preference. Upon folding, minor lid 76 is preferably adhesively adhered or otherwise affixed to major lid 44, thus preserving first compartment slide 84 in first compartment 116 and second compartment slide 98 in second compartment 118.

Figure 5:
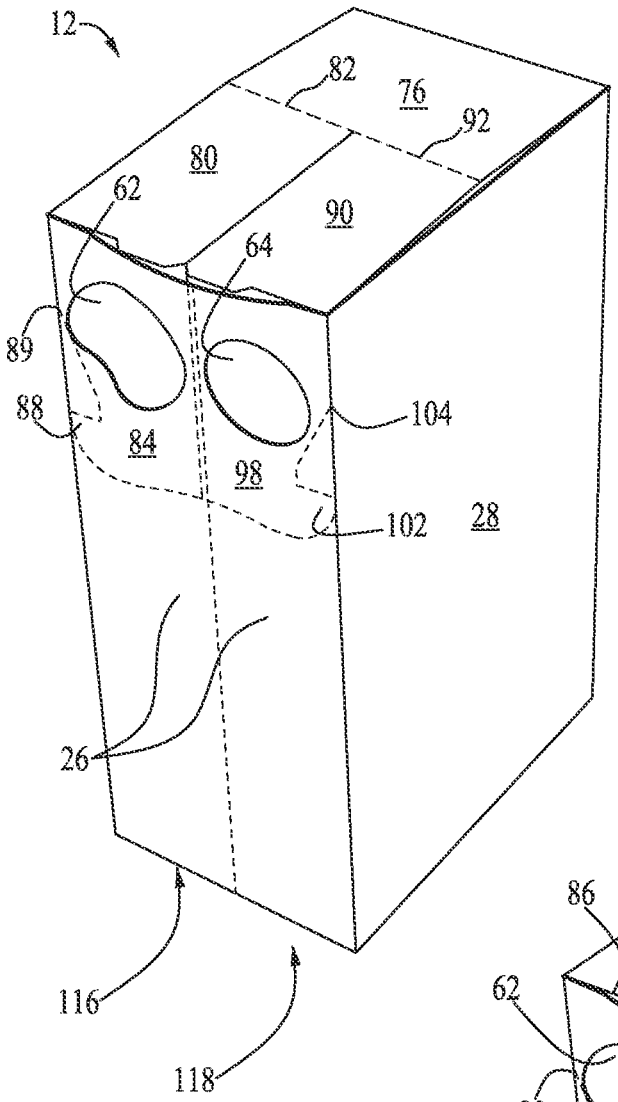
FIG. 5 is a perspective view of a fully assembled dual compartment box.

FIG. 5, shows the box 12 in a fully assembled state with the first compartment slide 84 and second compartment slide 98 in a closed configuration. The bottom end 16 of the box 12 is closed in a manner similar to a conventional box, preferably by folding over second bottom flap 66 and fourth bottom flap 106, folding over first bottom flap 40, and adhesively or otherwise adhering third bottom flap 72 to first bottom flap 40. In alternative embodiment, the various bottom flaps 40, 66, 72, 106 may be folded in a different order according to preference. Additionally, the top end 14 or bottom end 16 may be alternatively folded first or second depending on whether the pourable products are introduced to the first compartment 116 and second compartment 118 from the top or bottom of the box 12.

Figure 6:
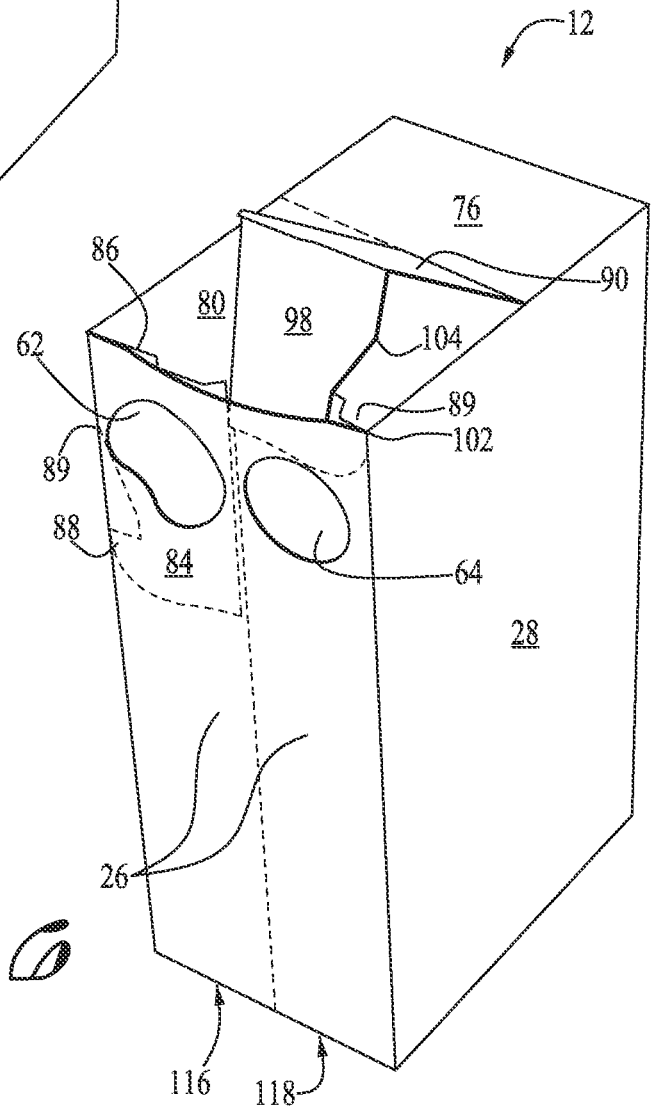
FIG. 6 is a perspective view of a fully assembled dual compartment box, showing one slide opened for accessing one of the two compartments.

Referring to FIG. 6, second compartment side flap 90 and second compartment slide 98 are in an upward position from the box 12 so that second compartment aperture 64 is exposed, creating access to second compartment 118. Interaction between second catch 89 from major lid 44 and third catch 102 from second compartment slide 98 prevents second compartment slide 98 from disengaging with major lid 44 and second compartment 118.

Figure 7:
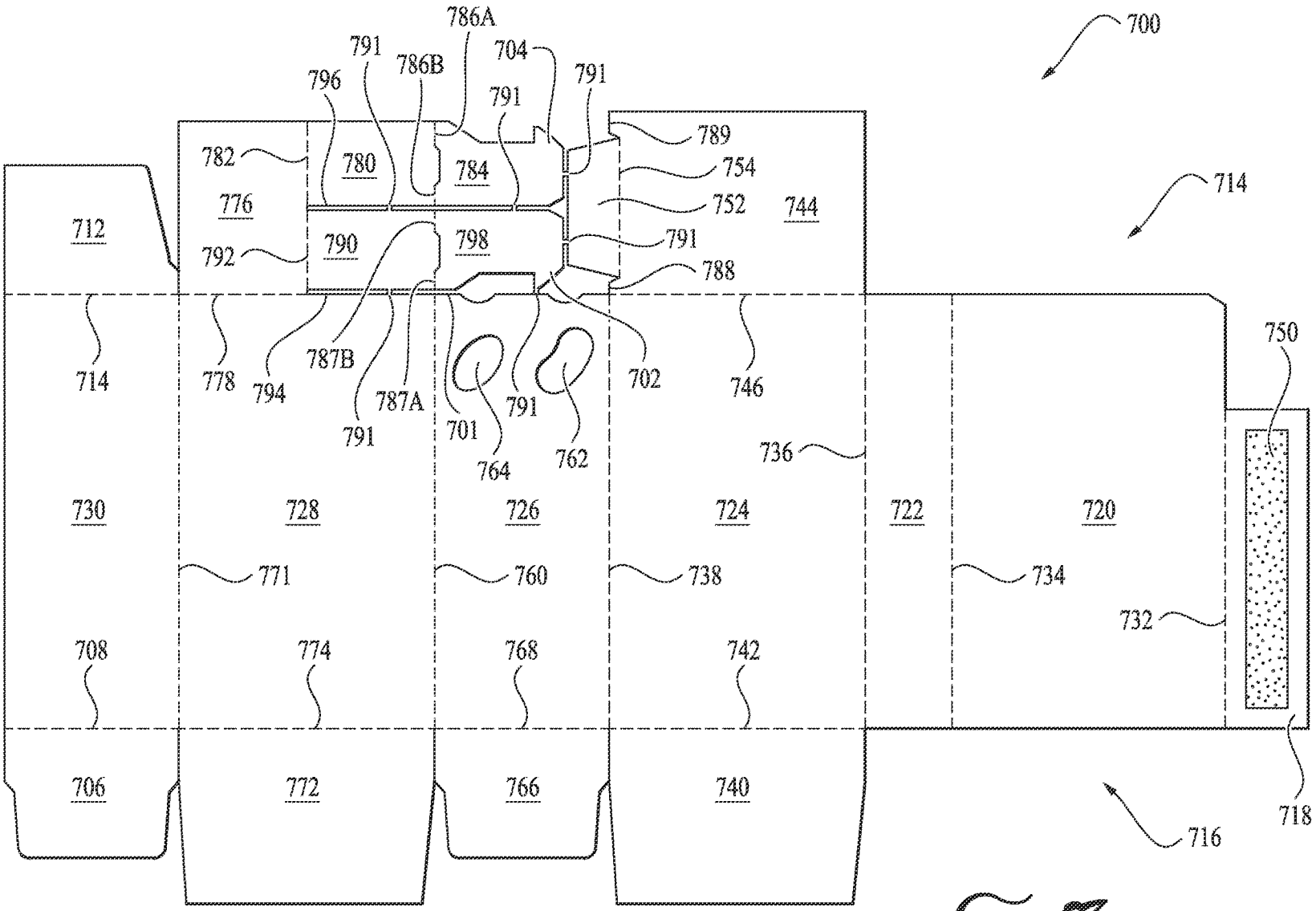
FIG. 7 is a top plan view of a second embodiment of a cardboard blank which can be folded to form a dual compartment box with slide openings.

Referring now to FIG. 7, there is shown a second embodiment of a die cut paper or cardboard blank 700 that may be used to form the box 12 (FIGS. 3-6). The box 12 is configured to dispense two or more products and have two or more compartments to effectuate this. The cardboard blank 700 has a top end 714 and a bottom end 716 and is scored for folding such that the box 12 has at least two compartments, a first compartment 116 and a second compartment 118 (FIG. 3), preferably adjacent to one another. Major portions of the cardboard blank include inner tab 718, at least one dual compartment separator panel 720, first compartment rear panel 722, first compartment side panel 724, front panel 726, second compartment side panel 728, rear panel 730, preferably all arranged in series and preferably configured in a foldable relationship to one another. If box 12 has more than two compartments 116, 118, then the blank 700 can comprise more than one separator panel 720 to separate the more than two compartments 116, 118.

Still referring to FIG. 7, inner tab 718 is connected to the at least one dual compartment separator panel 720 along inner tab fold line 732. The at least one dual compartment separator panel 720 is connected to first compartment rear panel 722 by dual compartment separator panel fold line 734. First compartment rear panel 722 is connected to first compartment side panel 724 by first compartment rear panel fold line 736. First compartment side panel 724 is connected to front panel 726 by first compartment side panel fold line 738. First compartment side panel 724 includes first bottom flap 740 connected along first bottom flap fold line 742. First compartment side panel 724 also includes major lid 744 connected along major lid fold line 746, and front tab 752 connected along front tab fold line 754. Note that tab 48 of the first embodiment 10 is missing from the second embodiment 700. This is because tab 48 is optional and can be excluded to reduce the overall size of the blank 10, 700 for paper or cardboard material savings. Major lid 744 includes first catch 788 and second catch 789. Note that the second embodiment 700 shows an optional shape for front tab 725, wherein the first appendage 56 and second appendage 58 that are present in the first embodiment 10, are not present in the second embodiment 700.

Front panel 726 is connected to second compartment side panel 728 along front panel fold line 760. Front panel 726 lacks a top tab, but includes a second bottom flap 766 connected along second bottom flap fold line 768. Second bottom flap 766 is adjacent first bottom flap 740 and separated by first cut line 770. Front panel 276 includes first compartment aperture 762 and second compartment aperture 764.

Second compartment side panel 728 is connected to rear panel 730 along second compartment side panel fold line 771. Second compartment side panel 728 includes third bottom flap 772 connected along third bottom flap fold line 774. Third bottom tab 772 is adjacent second bottom tab 766, separated along second cut line 775. Second compartment side panel 728 also includes minor lid 776 connected along minor lid fold line 778. Both minor lid 776 and minor lid fold line 778 are preferably approximately one-half the width of second compartment side panel 728.

Along the remaining width of the top end 714 of the second compartment side panel 728 is third cut line 794. Second compartment slide flap 790 is adjacent second compartment side panel 728 along third cut line 794. Second compartment slide 798 is connected to second compartment slide flap 790 along second compartment slide fold lines 787A, 787B, and is partially adjacent front panel 726 along fifth cut line 701. Second compartment slide 798 includes third catch 702. First compartment slide flap 780 is attached to minor lid 776 along first compartment slide flap fold line 782, and adjacent to second compartment slide flap 790 along fourth cut line 796. First compartment slide 784 is connected to first compartment slide flap 780 along first compartment slide fold lines 786A, 786B, and adjacent to second compartment slide 98 along fourth cut line 96. First compartment slide 784 includes fourth catch 704.

Rear panel 730 is connected to second compartment side panel 728 along second compartment side panel fold line 771. Rear panel 730 includes fourth bottom flap 706 connected along fourth bottom flap fold line 708 and top flap 712 connected along top flap fold line 714. Fourth bottom flap 706 is adjacent third bottom tab 772 along sixth cut line 710. As shown by the arrow in FIG. 1, a first step in assembling the box 12 from the cardboard blank 10, 700 may be folding inner tab 18, 718, dual compartment separator panel 20, 720, first compartment rear panel 22, 722, and first compartment side panel 24, 724 preferably over one-half the width of front panel 26, 726.

The notable difference between the first embodiment 10 and the second embodiment 700 is the configuration of the first and second compartment slides 784, 798 and the front tab 752.

In the first embodiment 10, in the unfolded position/configuration shown in FIG. 1, the slides 84, 94 do not contact the front tab 52, and the front tab 52 has first and second appendages 56, 58.

In the second embodiment 700, in the unfolded position/configuration shown in FIG. 7, the slides 784, 798 contact the front tab 752. Optionally, the slides 784, 798 are connected to the front tab 752 by one or more breakable nicks

791. Optionally, a plurality of breakable nicks 791 can be used, as necessary by the manufacturer and/or high-speed folding and forming machinery. The nicks 791 are small pieces of material that removably couple the various parts of the blank 700 to other parts of the blank 700 and can be broken when the box 12 is fully assembled and ready to be used by a user/consumer.

The extended length of the slides 784, 798 such that they are removably coupled to the front tab 752 allow the blank 700 to be utilized by conventional, high-speed folding and forming machinery. Due to the breakable nicks 791 connecting the slides 784, 798 to the rest of the blank 700, slides 784, 798 remain flat with the rest of the blank 700 through the entire folding and forming process, and the breakable nicks 791 are broken whenever the slides 784, 798 are lifted for dispensing the contents therein.

Referring to FIGS. 2 through 6, the folding of the second embodiment 700 is the same as the folding of the first embodiment 10. While the resulting box 12 is shown with two compartments 116, 118, it should be noted that blanks 10, 700 can be configured to form a box with two or more compartments.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A blank for forming a box, the blank comprising:

a) a plurality of panels comprising:
- i) an inner tab;
- ii) at least one dual compartment separator panel;
- iii) a first compartment rear panel;
- iv) a first compartment side panel having a front tab foldably coupled thereto;
- v) a front panel having two or more apertures;
- vi) a second compartment side panel; and
- vii) a rear panel;

b) at least two compartment slides foldably coupled to the second compartment side panel and removably coupled to the front tab;

wherein the plurality of panels are configured to form a box having two or more compartments, the two or more compartments sharing the front panel with the two or more apertures, one for each compartment, the two or more compartment slides being independently moveable to selectively block and unblock their respective aperture;

d) the at least one separator panel located between the two or more compartments upon formation of the box; and e) the front tab configured to press the at least two compartment slides against the front panel proximate the apertures upon formation of the box.

2. The blank of claim 1, wherein the at least two compartment slides each having a catch to keep at least a portion of the compartments slides captive inside the box upon formation of the box.

3. The blank of claim 1 wherein a lateral edge of the first compartment rear panel being is connected to the rear panel upon formation of the box.

4. The blank of claim 1 wherein the first and second compartments fully extend to a bottom of the box.

5. The blank of claim 1, wherein the first compartment slide and the second compartment slide are vertically movable within an interior of the box.

6. The blank of claim 1, wherein the blank has a plurality of flap portions foldably extending from the plurality panels, the flap portions being top and bottom flaps.

7. The blank of claim 1, wherein the at least one separator panel is at least partially defined by the inner tab to one edge of the panel, the inner tab being connected to an interior of the front panel.

8. A box for dispensing two or more products, the box comprising:

a) a single blank having:
- i) a plurality of panels foldably connected together and configured to form the box having at least two compartments the panels comprising:
  - A) an inner tab;
  - B) at least one dual compartment separator panel;
  - C) a first compartment rear panel;
  - D) a first compartment side panel having a front tab foldably coupled thereto;
  - E) a front panel having two or more apertures;
  - F) a second compartment side panel; and
  - G) a rear panel;
- ii) at least two compartment slides foldably coupled to the second compartment side panel and removably coupled to the front tab, each slide having a catch to keep at least a portion of the at least two compartment slides captive inside the box upon formation of the box;

the two or more compartments sharing the front panel with the at least two apertures, one for each compartment, and the two or more compartment slides being independently moveable to selectively block and unblock their respective aperture; and

- iii) the front tab configured to press at least the two or more compartment slides against the front panel proximate the apertures upon formation of the box.

9. The box of claim 8, a lateral edge of the first compartment rear panel being is adhesively connected to the rear panel.

10. The box of claim 8, wherein the two or more compartments fully extend to a bottom of the box.

11. The box of claim 8, wherein the slides are movable within an interior of the box adjacent the front panel.

12. The box of claim 8, wherein the box comprises a plurality of flap portions foldably connected to the plurality of panels, the flap portions being top flaps and bottom flaps.

13. The box of claim 8, wherein the at least one separator panel is at least partially defined by the inner tab to one edge of the panel, the inner tab being connected to an interior of the front panel.

* * * * *